US005868282A

United States Patent [19]

Imhoff

[11] Patent Number: 5,868,282

[45] Date of Patent: Feb. 9, 1999

[54] TOOTHPASTE DISPENSER WITH AN ADAPTOR BASE

[75] Inventor: Harold J. Imhoff, Winter Haven, Fla.

[73] Assignee: Ravindra J. Waikar, Marietta, Ga.

[21] Appl. No.: 687,168

[22] Filed: Jul. 24, 1996

Related U.S. Application Data

[60] Provisional application No. 60/001,712 Jul. 28, 1995.

[51] Int. Cl. [6] ..... B65D 35/28

[52] U.S. Cl. ..... 222/101; 222/105

[58] Field of Search ..... 222/101, 103, 222/105, 185.1

[56] References Cited

U.S. PATENT DOCUMENTS

| | | |
|---|---|---|
| 1,352,425 | 9/1920 | Boye . |
| 1,924,195 | 8/1933 | Miles . |
| 2,168,080 | 8/1939 | Allen . |
| 2,461,891 | 2/1949 | Giles . |
| 2,545,342 | 3/1951 | Choquette . |
| 2,936,006 | 5/1960 | Henley . |
| 5,203,473 | 4/1993 | Willey . |

*Primary Examiner*—Gregory L. Huson
*Attorney, Agent, or Firm*—Rader, Fishman, Grauer & McGarry

[57] ABSTRACT

A dispenser for a material contained within a flexible tube includes a main body that has a longitudinally extending front surface for supporting the tube, an opposing rear surface, a pair of side walls that extend upwardly from the front surface and along the longitudinal extent thereof, and a gear rack extending adjacent to an inner surface of each of the side walls. Preferably, the side walls are spaced apart a sufficient distance to receive the tube and the gear racks therebetween. An elongate roller has a shaft that extends from each end of the roller and each shaft projects through a slot and one of the side walls. Each shaft further includes a gear positioned between the roller and one of the side walls and in alignment with one of the gear racks. Each gear is in meshing engagement with its corresponding gear rack. A knob is attached to an outer end of at least one shaft for rotating the roller and gears with respect to the gear racks for moving the roller along the longitudinal extent of the front surface. The roller is spaced a sufficient distance from the front surface of the main body to thereby press the tube between the roller and the front surface and to force the material in the tube toward the tube spout. A toothbrush holder is mounted to and extends rearwardly from the main body rear surface. A wall mount is attached to a recess located in a rear surface of the toothbrush holder for mounting the dispenser to a wall. A portion of the adaptor base is received in the mounting recess when positioning the dispenser on a horizontal surface.

19 Claims, 3 Drawing Sheets

TOOTHPASTE DISPENSER WITH AN ADAPTOR BASE

This application claims the benefit of U.S. Provisional Application No. 60/001,712 filed on Jul. 28, 1995.

BACKGROUND OF THE INVENTION

1. Field of the Invention

This invention relates to toothpaste dispensing fixtures in general and, in particular, to a toothpaste dispensing fixture having a roller to sequentially squeeze toothpaste from the rear of a tube to a tube spout.

2. State of the Prior Art

Toothpaste for consumer use has long been sold in tubes requiring the user to squeeze part of the tube to extract the paste from a spout at one end of the tube. For many years, the tubes in which the toothpaste was distributed were fabricated from a malleable metal thereby permitting the user to readily extract the paste. In order to efficiently extract the maximum amount of paste from the tube, the user needed to progressively squeeze the tube from the bottom of the tube to the tube spout. As the tube was squeezed from the bottom, the metal tube could be rolled toward the tube spout, thereby effectively preventing the paste from being redistributed to the bottom of the tube should the user squeeze at a midpoint of the tube.

In recent years, the malleable metal tubes have been replaced by tubes fabricated from plastics materials. The new plastic tubes are still squeezable by the user to extract paste from the tube. However, the plastic material used in the new tubes tends to return to its original shape after it is deformed, thereby essentially making it impossible for the user to roll the bottom of the tube to prevent the paste from being redistributed thereto should the user squeeze at a midpoint of the tube.

Prior toothpaste dispensers have a body with a planar upper surface and parallel racks which mesh with pinion gears mounted on an axle journalled in sidewalls in the body. The axle also mounts a roller between the pinion gears for contact with a toothpaste tube positioned on the body upper surface and a knob for rotating the axle and roller with respect to the racks. The upper surface of the body has a device for holding the end of the toothpaste tube in a fixed position. The lower end of the body has an end plate with a centrally disposed aperture for receiving the spout of the toothpaste tube.

Many different designs of toothpaste dispensers with the above characteristics have been disclosed, and embodiments of such dispensers are found in U.S. Pat. Nos. 5,203,473 to Willey; 2,936,006 to Henley; 2,545,324 to Choquette; 2,461,891 to Giles; 2,168,080 to Allen; 1,924,195 to Miles; and 1,352,425 to Boye. The rollers in the above-referenced inventions are typically elongated cylinders with the exception of a spherical roller disclosed in Giles '891. Each of the above-referenced dispensers includes an upper mounting bracket for attaching the dispenser to a wall. Choquette '342 additionally discloses legs extending downwardly from the body.

SUMMARY OF THE INVENTION

A dispenser for a material contained within a flexible tube, according to the invention, includes a main body that has a longitudinally extending front surface for supporting the tube, an opposing rear surface, a pair of side walls that extend upwardly from the front surface and along the longitudinal extent thereof, and a gear rack extending adjacent to an inner surface of each of the side walls. Preferably, the side walls are spaced apart a sufficient distance to receive the tube and the gear racks therebetween.

An elongate roller has a shaft that extends from each end of the roller and each shaft projects through a slot and one of the side walls. Each shaft further includes a gear positioned between the roller and one of the side walls and in alignment with one of the gear racks. Each gear is in meshing engagement with its corresponding gear rack.

A knob is attached to an outer end of at least one shaft for rotating the roller and gears with respect to the gear racks for moving the roller along the longitudinal extent of the front surface. The roller is spaced a sufficient distance from the front surface of the main body to thereby press the tube between the roller and the front surface and to force the material in the tube toward the tube spout.

An adaptor base extends rearwardly from the rear surface of the main body. Advantageously, the adaptor base is movable between a stored position for mounting the dispenser on a wall and an in-use position for positioning the dispenser on a horizontal surface. The adaptor base includes a gripping surface that is adapted to support an upper portion of the main body and a positioning surface that is adapted for contacting a horizontal surface. Preferably, the gripping surface is oriented at an acute angle with respect to the positioning surface for positioning the upper surface of the main body at the acute angle with respect to the horizontal surface.

The front surface of the main body preferably includes a front surface contour defined by an upper surface portion and a lower surface portion. The front surface portion forms an obtuse angle with respect to the lower surface portion, and the slot in each side wall and the rack adjacent each side wall follow the front surface contour.

A latch plate is rotatably attached to the main body at a lower end thereof and includes an aperture for receiving the spout of the tube. A clamping mechanism is attached to the main body at an upper end thereof for clamping the second end of the tubing to the front surface.

A toothbrush holder is mounted to and extends rearwardly from the main body rear surface. Preferably, a wall mount is attached to a recess located in a rear surface of the toothbrush holder for mounting the dispenser to a wall. A portion of the adaptor base is received in the mounting recess when positioning the dispenser on a horizontal surface.

A pair of lower support legs preferably extend rearwardly from opposite sides of a lower portion of the main body a distance equal to the rearward extent of the toothbrush holder. A rear cavity is formed between the toothbrush holder and the pair of legs, and the adaptor base is received in the cavity in the stored position, such that the rear surface of the toothbrush holder and a rear surface of the legs contact a wall when the dispenser is mounted thereto.

These and other features, advantages and objects of the invention will be apparent from the ensuing description taken in conjunction with the accompanying drawings.

BRIEF DESCRIPTION OF THE DRAWINGS

The invention will now be described with reference to the accompanying drawings in which.

DESCRIPTION OF THE PREFERRED EMBODIMENT

Figure 1:
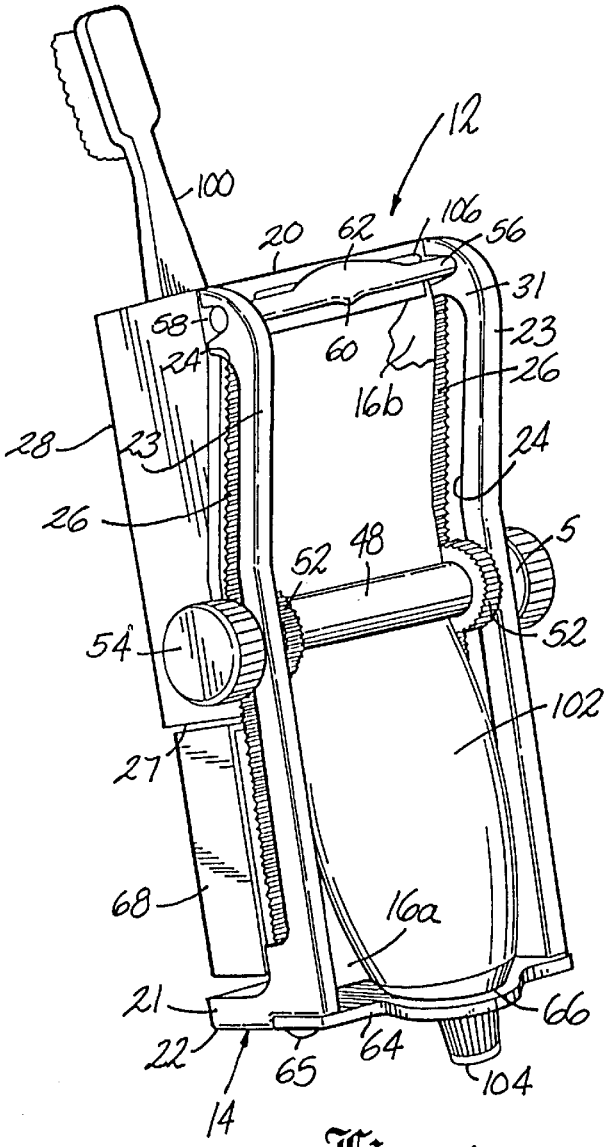
FIG. 1 is a perspective view of a toothpaste dispenser according to the invention showing a partially dispensed tube of toothpaste and a stored toothbrush in the dispenser.
Figure 3:
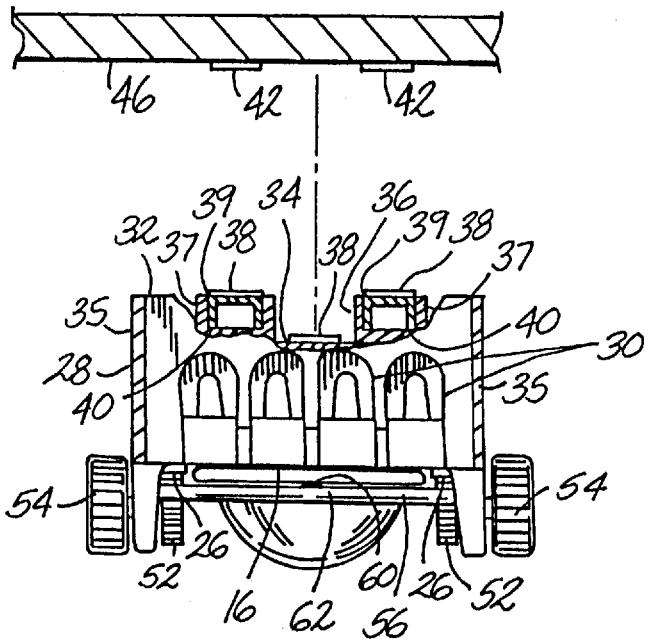
FIG. 3 is a top view of the dispenser positioned for mounting on a wall.

Referring now to the drawings, and to FIGS. 1 and 3 in particular, a toothpaste dispenser fixture 12 according to the invention comprises a rectangular, box-like main body 14 and a toothbrush holder 28 affixed to the main body 14. The toothpaste dispenser fixture 12 can be wall-mounted or disposed on a horizontal surface and provides for the sequential squeezing of toothpaste out of a toothpaste tube from the rear of the tube to the front thereof.

The main body 14 comprises a planar front surface 16 on which a tube of toothpaste 102 is positioned and an opposing rear surface 18. A pair of U-shaped sides 23 (FIG. 5) are oppositely disposed along the main body 14 and extend upwardly beyond the planar front surface 16. A pair of slots 24 extend through both legs of each U-shaped side 23 for receiving the axle 50 of a roller 48 (FIG. 5) as will be more fully described below.

Figure 2:
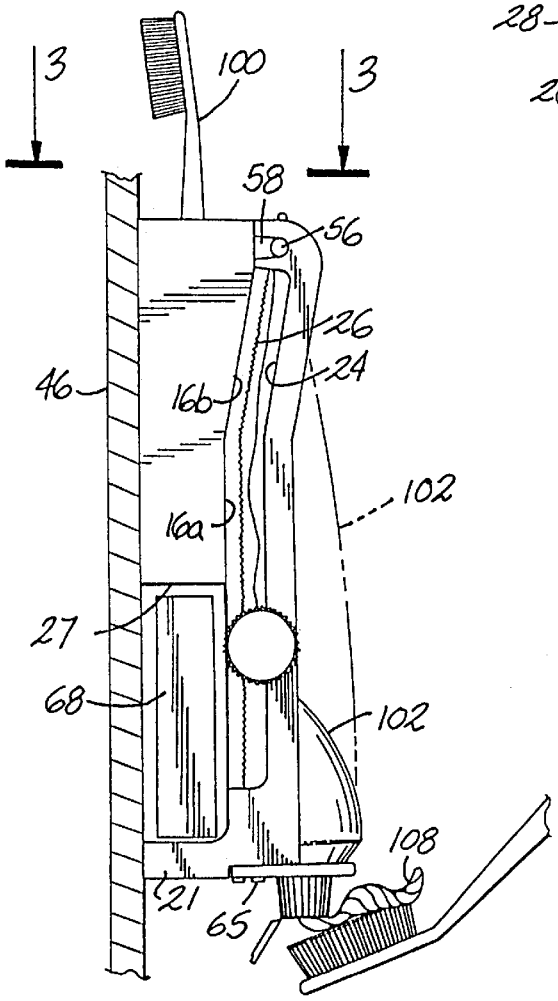
FIG. 2 is a side view of the dispenser mounted on a wall.

Opposing parallel racks 26 are located proximate to the inner surface 31 of the side walls 23. The racks 26 can be formed integrally with the front surface 16 or separately formed and attached to the front surface. As shown in FIG. 2, the front surface 16 is divided between an upper planar surface portion 16*a* and a lower planar surface portion 16*b*. The upper surface portion 16*a* forms an angle of about 10° with respect to the lower surface portion 16*b*. The slots 24 and rack 26 follow the contour of the upper and lower surface portions 16*a* and 16*b* to define upper and lower slot and rack portions. The upper portion of each slot and the upper portion of each rack therefore form an angle of about 10° with respect to the lower portion of each slot and rack. This configuration alleviates pressure on the tube 102 at the tube spout 104. The slope of the upper surface portion 16*b* also reduces pressure on the toothpaste tube during installation and clamping of the tube in the holder with a clamping rod 56. A support leg 21 depends downwardly from each side wall 23 at a lower end 22 of the main body 14. A bottom plate 33 (FIG. 6) depends downwardly from the rear surface 18 and interconnects the support legs 21. Preferably, the legs 21 and bottom plate 33 project orthogonally downward with respect to the rear surface 18 for supporting lower end 22.

Figure 5:
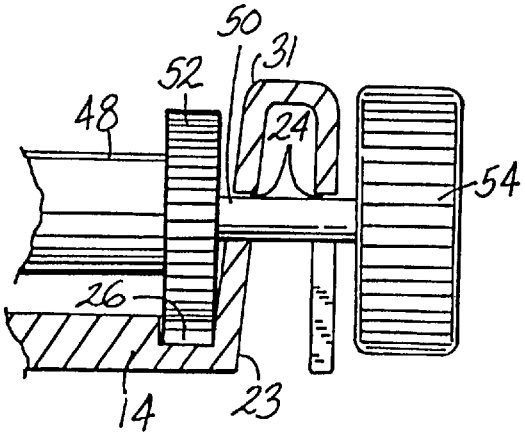
FIG. 5 is a partial sectional view of the dispenser body taken along line 5—5 of FIG. 4 and illustrating a roller and attached pinion gear in registration with a gear rack.

Referring to FIG. 5, a drive mechanism will now be described with respect to only one side of the dispenser 12. It is to be understood, however, that the opposite side is similarly constructed. An axle 50 is journalled within the pair of slots 24 of each side wall 23. A pinion gear 52 is mounted to the axle 50 near the end of the axle proximate to the inner surface 31 of the side wall 23 and in registry with the rack 26 on the front surface 16. A roller 48 is disposed on the axle 50 between the pinion gears 52. At least one end of the axle 50 mounts a knob 54 for rotating the pinion gears 52 to move the roller 48 with respect to the racks 26.

Referring again to FIG. 1, a clamping rod 56 is positioned at the upper end 20 of the main body 14 and is rotatably mounted between the side walls 23 in apertures 58 for clamping an end 106 of the toothpaste tube to the upper surface portion 16*a*. An actuating tab 62 sized for grasping by fingers projects outwardly from the clamping rod 56 and a clamping tab 60 projects outwardly from the clamping rod 56 opposite the actuating tab 62. The clamping tab 60 is sized to clamp and retain the end 106 of a toothpaste tube 102 between the clamping tab 60 and the front surface 16 of main body 14.

Figure 6:
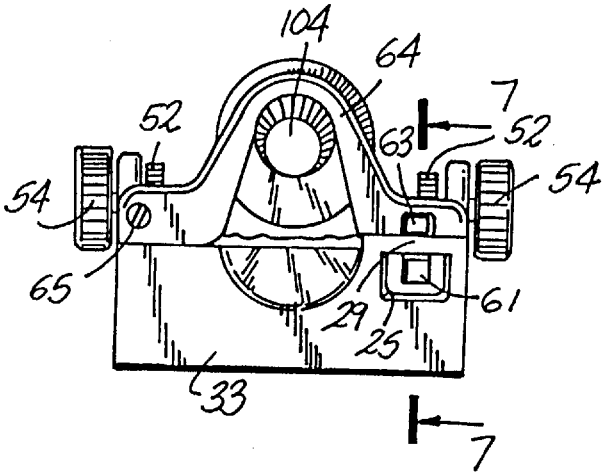
FIG. 6 is a front elevational view of the dispenser shown in FIG. 4.
Figure 7:
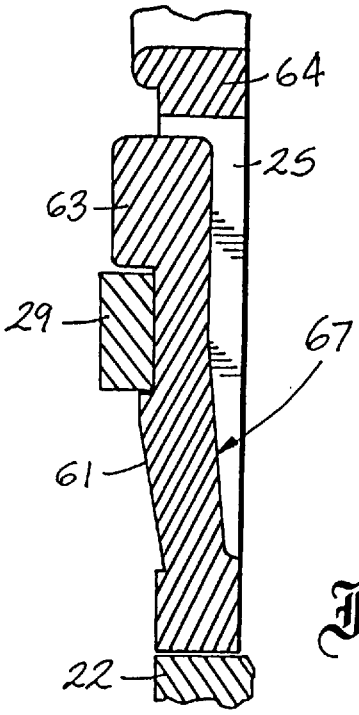
FIG. 7 is a sectional view of the dispenser taken along line 7—7 of FIG. 6 and illustrating a toothpaste tube latching mechanism.

As illustrated in FIGS. 6 and 7, the lower end 22 of the main body 14 has a latch plate 64 in which is formed a spout aperture 66 for receiving the spout 104 of toothpaste tube 102. The left side of the latch plate 64 is rotatably mounted to the main body 14 by a threaded fastener 65 which extends through the latch plate 64 and into the lower end 22 of the main body 14. The latch plate has a cantilevered latch 67 with a forwardly projecting latch button 63 and a ramped catch 61. The bottom plate 33 includes a retaining bar 29 against which the ramped catch 61 is biased and an opening 25 adjacent thereto for receiving the button 63. Pushing in on the latch button 63 releases the ramped catch 61 from the retaining bar 29 so that the latch plate 64 can pivot counterclockwise (as viewed in FIG. 6) about the fastener 65. The toothpaste tube can be easily loaded when the latch plate 64 is in the open position. When the toothpaste tube 102 is loaded in the dispenser 12, the latch plate 64 is rotated into the position shown in FIG. 1 to capture the spout 104 of the toothpaste tube 102.

With reference now to FIGS. 1–3, the toothbrush holder 28 is mounted to the rear surface 18 of the main body 14 at the upper end 20 thereof and forms a rear cavity 27 along with the rear surface 18 and legs 21. The upper end of the toothbrush holder 28 has a plurality of apertures 30, each of which is sized to receive a toothbrush 100. The rear surface 32 of the toothbrush holder 28 has a central mounting recess 36 for locating the dispenser 12 on a horizontal surface, as will be described in further detail below, and a pair of side mounting recesses 37 for locating the dispenser 12 on a wall or other vertical surface. A C-shaped channel 40 is located in each side recess 37 such that a back surface 39 of each channel faces rearwardly. The channels 40 are preferably formed separately and adhesively secured within the recesses 37. Alternatively, the channels can be integrally formed with the recesses 37. A hook strip 38 from a hook and loop fastener is affixed to the back surface 39 of each channel 40 and to a recessed channel 34 within the mounting recess 36. Initially, a loop strip 42 is attached to each hook strip 38 associated with the back surfaces 39. When it is desired to mount the dispenser 12 to a wall 36, the loop strips 42 are detached from the hook strips 38 and adhesively attached to the wall 36. The hook strips 38 on the dispenser 12 are then aligned with the loop strips 42 on the wall and pressed together. The dispenser 12 can thus be affixed to a wall 46 in a secure manner and can be readily removed by pulling on the dispenser and separating the hook strips 38 from the loop strips 42.

Figure 4:
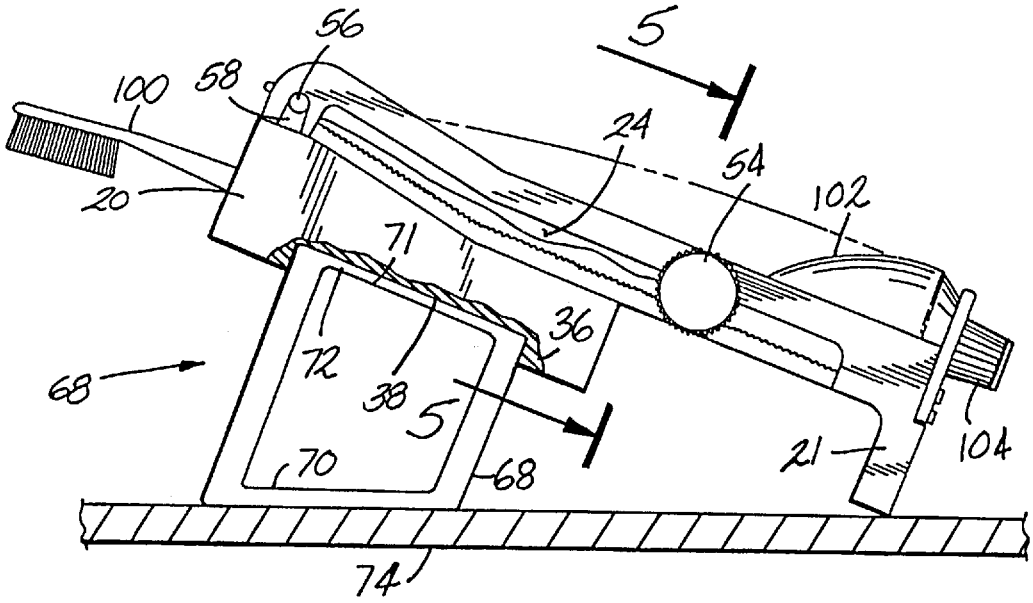
FIG. 4 is a side elevational view of the dispenser mounted on a support block and resting on a countertop.

Alternatively to wall mounting, the fixture 12 can be positioned on a countertop 74, as illustrated in FIG. 4. The upper end 20 of the fixture 12 is mounted on a support base 68. One end of the support base 68 has a positioning surface 70 which is disposed at an acute angle to an opposite gripping surface 71. The positioning surface 70 corresponds to the angle at which the fixture is desired to rest on the countertop 74. A loop strip 72 is affixed to the gripping surface 71 of support base 68. To convert the fixture 12 to a countertop configuration, the gripping surface with the attached loop strip 72 is inserted into the mounting recess 36 in toothbrush holder 28 and is securely retained therein by the inter-engagement of the hook strip 38 affixed to the recessed channel 34 and the loop strip. When it is desired to mount the fixture 12 on a wall 46, the support base 68 is disengaged from hook strip 38 and is stored in the cavity 27, as illustrated in FIGS. 1 and 2. Preferably, the support base 68 and the fixture 12 have complementary strips of hook and loop fasteners for securing the support base 68 within the cavity 27.

In operation, a tube of toothpaste 102 is positioned on the front surface 16 between the racks 26. The rear end 106 of the toothpaste tube is positioned between the upper front surface portion 16*a* and the clamping rod 56. The clamping rod 56 is then rotated within apertures 58 by applying a rotational force to actuating tab 62 until the clamping tab 60 contacts and clamps the rear end 106 of the toothpaste tube 102 between the clamping rod 56 and upper surface 16*a*. The latch plate 64 is rotated outwardly a sufficient amount from the lower surface 16*b* to receive a spout 104 of the tube 102. The latch plate 64 is then rotated inwardly until the button 63 of the latch mechanism 67 snaps over the retaining bar 29. When properly installed, the spout 104 projects through the spout aperture 66.

The spout 104 is opened and as the knob 54 is turned clockwise as viewed in FIGS. 1, 2 and 4, the pinion gears 52 in registration with racks 26 advance the roller 48 from the rear end 106 of the toothpaste tube 102 toward the spout 104. The roller 48 thereby flattens the toothpaste tube 102 against the front surface 16 and squeezes toothpaste 108 from the tube 102 out through the spout 104.

While the invention has been described in connection with a dispenser for use with a tube of toothpaste, it is to be understood that the invention is not necessarily so limited, and that the invention can be practiced where cookie dough, pastry, frosting or other confectioneries, caulking, adhesives, etc., are to be pressed or dispensed from flexible tube-like containers. The particular dimensions of the dispenser can be adjusted to accommodate larger or smaller tubes.

Reasonable variation and modification are possible within the spirit of the foregoing specification and drawings without departing from the scope of the invention.

I claim:

1. A dispenser for a material contained within a flexible tube, the tube having a first end with a spout and a second end, the dispenser comprising:

a main body having a longitudinally extending front surface for supporting the tube, an opposing rear surface, a pair of side walls extending upwardly from the front surface and along the longitudinal extent thereof, and a gear rack extending adjacent to an inner surface of each of the side walls, the side walls being spaced apart a sufficient distance to receive the tube and the gear racks therebetween;

an elongate roller having a shaft extending from each end thereof, each shaft projecting through a slot in one of the side walls, each shaft further including a gear positioned between the roller and one of the side walls and in alignment with one of the gear racks, each gear being in meshing engagement with its corresponding gear rack;

a knob attached to an outer end of at least one shaft for rotating the roller and gears with respect to the gear racks for moving the roller along the longitudinal extent of the front surface, the roller being spaced a sufficient distance from the front surface to thereby press the tube between the roller and the front surface and to force the material in the tube toward the tube spout; and an adaptor base extending rearwardly from the rear surface of the main body, the adaptor base being movable between a stored position for mounting the dispenser on a wall and an in-use position for positioning the dispenser on a horizontal surface.

2. A dispenser according to claim 1 wherein the front surface includes a front surface contour defined by an upper surface portion and a lower surface portion, the front surface portion forming an obtuse angle with respect to the lower surface portion, and wherein the slot in each side wall and the rack adjacent each side wall follow the front surface contour.

3. A dispenser according to claim 2 wherein a latch plate is rotatably attached to the main body at a lower end thereof, the latch plate including an aperture for receiving the spout of the tube.

4. A dispenser according to claim 3 wherein the latch plate further comprises a latching mechanism for locking the latch plate in a closed position.

5. A dispenser according to claim 4 and further comprising a clamping mechanism attached to the main body at an upper end thereof for clamping the second end of the tubing to the front surface.

6. A dispenser according to claim 1 wherein a latch plate is rotatably attached to the main body at a lower end thereof, the latch plate including an aperture for receiving the spout of the tube.

7. A dispenser according to claim 6 wherein the latch plate further comprises a latching mechanism for locking the latch plate in a closed position.

8. A dispenser according to claim 7 and further comprising a clamping mechanism attached to the main body at an upper end thereof for clamping the second end of the tubing to the front surface.

9. A dispenser according to claim 1 and further comprising a clamping mechanism attached to the main body at an upper end thereof for clamping the second end of the tubing to the front surface.

10. A dispenser according to claim 1 wherein the adaptor base includes a gripping surface that is adapted to support an upper portion of the main body and a positioning surface that is adapted for contacting a horizontal surface, and wherein the gripping surface is oriented at an acute angle with respect to the positioning surface for positioning the upper surface of the main body at the acute angle with respect to the horizontal surface.

11. A dispenser for a tube of toothpaste, the tube having a first end with a spout and a second sealed end, the dispenser comprising:

a main body having a longitudinally extending front surface for supporting the tube, an opposing rear surface, a pair of side walls extending upwardly from the front surface and along the longitudinal extent thereof, and a gear rack extending adjacent to an inner surface of each of the side walls, the side walls being spaced apart a sufficient distance to receive the tube and the gear racks therebetween;

an elongate roller having a shaft extending from each end thereof, each shaft projecting through a slot in one of the side walls, each shaft further including a gear positioned between the roller and one of the side walls and in alignment with one of the gear racks, each gear being in meshing engagement with its corresponding gear rack;

a knob attached to an outer end of at least one shaft for rotating the roller and gears with respect to the gear racks for moving the roller along the longitudinal extend of the front surface to thereby press the tube between the roller and the front surface and to force the toothpaste in the tube toward the tube spout;

an adapter base extending rearwardly from the rear surface of the main body, the adaptor base being movable between a stored position for mounting the dispenser on a wall and an in-use position for positioning the dispenser on a horizontal surface; and a toothbrush holder extending rearwardly from the main body rear surface.

12. A dispenser according to claim 11 wherein a wall mount is attached to a rear surface of the toothbrush holder for mounting the dispenser to a wall.

13. A dispenser according to claim 12 wherein the toothbrush holder rear surface has a mounting recess and the wall mount is attached to the mounting recess.

14. A dispenser according to claim 13 wherein a portion of the adaptor base is received in the mounting recess for positioning the dispenser on a horizontal surface.

15. A dispenser according to claim 14 and further comprising a pair of lower support legs extending rearwardly from opposite sides of a lower portion of the main body a distance equal to the rearward extent of the toothbrush holder.

16. A dispenser according to claim 15 wherein a rear cavity is formed between the toothbrush holder and the pair of legs, and wherein the adaptor base is received in the cavity in the stored position, such that the rear surface of the toothbrush holder and a rear surface of the legs contact a wall when the dispenser is mounted thereto.

17. A dispenser according to claim 14 wherein the adaptor base includes a gripping surface that is received in the mounting recess and a positioning surface that is adapted for contacting a horizontal surface, and wherein the gripping surface is oriented at an acute angle with respect to the positioning surface for positioning the upper surface of the main body at the acute angle with respect to the horizontal surface.

18. A dispenser according to claim 11 wherein a wall mount is attached to a rear surface of the toothbrush holder for mounting the dispenser to a wall.

19. A dispenser according to claim 18 wherein the toothbrush holder rear surface has a mounting recess and the wall mount is attached to the mounting recess.

* * * * *